US005411378A

United States Patent [19]

Sipin

[11] Patent Number: 5,411,378

[45] Date of Patent: May 2, 1995

[54] ORBITING FLUID PUMP

[76] Inventor: Anatole J. Sipin, 221 E. 78th St., New York, N.Y. 10021

[21] Appl. No.: 16,207

[22] Filed: Sep. 8, 1992

[51] Int. Cl.[6] ..... F04B 17/00

[52] U.S. Cl. ..... 417/360; 417/420

[58] Field of Search ..... 417/420, 360, 423.1, 417/319; 604/151

[56] References Cited

U.S. PATENT DOCUMENTS

| | | | |
|---|---|---|---|
| 2,107,090 | 2/1938 | Swennes | 415/70 |
| 2,773,953 | 12/1956 | Gemeinhardt | 415/70 |
| 3,702,938 | 11/1972 | Garnier | 290/52 |
| 4,487,557 | 12/1984 | Ruyak et al. | 417/420 |
| 4,772,660 | 2/1988 | Akamatsu | 415/70 |
| 4,927,337 | 5/1990 | Lustwerk | 47/420 |
| 5,021,048 | 6/1991 | Buckholtz | 604/151 |
| 5,044,882 | 9/1991 | Akamatsu | 415/182.1 |
| 5,045,026 | 9/1991 | Duse | 417/360 |
| 5,147,186 | 9/1992 | Buckholtz | 604/151 |

FOREIGN PATENT DOCUMENTS 3133177 3/1983 Germany .

OTHER PUBLICATIONS

"Vibratory Orbiting Blood Pump (VOBP)", International Workshop On Rotary Blood Pumps, Sep. 9–11, 1991.

*Primary Examiner*—Richard A. Bertsch
*Assistant Examiner*—Peter Korytnyk
*Attorney, Agent, or Firm*—Hedman, Gibson & Costigan

[57] ABSTRACT

Pumping action is performed by a unitary, sealed, easily replaceable pumping element, comprising a housing with a longitudinal axis, a pumping chamber at one end of the housing, an outlet in a wall of the pumping chamber, an inlet in the housing, axially spaced from the pumping chamber, and a circulator in the pumping chamber, mounted on a support which is free of the rotating elements, and which provides freedom of motion for the circulator to revolve in an orbital path about the longitudinal axis. Magnetic means external to the housing drive the circulator in its orbital path by magnetic action through the walls of the housing. The orbital circulator contains a magnetic element and is driven in a circular path by an external rotating magnetic field.

17 Claims, 9 Drawing Sheets

ORBITING FLUID PUMP

BACKGROUND OF THE INVENTION

The disclosed invention is a fluid pump having an easily replaceable pumping element that is free of bearings, frictional contact or rotating parts in the flow path, and that is also free of bearings, flexing seals or apertures leading to the exterior, except for the inlet and the outlet of the pumping element. While the new pump will be advantageous in many applications where leakage, fluid contamination and damage by or to the fluid are objectionable, such as pumping pharmaceuticals and biological and sanitary fluids, a major application will be as a blood pump for circulatory assist and also for cardiopulmonary bypass.

There has been an increasing interest in continuous, rotary blood pumps for circulatory assist and circulation maintenance, to alleviate problems identified with displacement types of ventricular assist devices such as infection, thrombosis and control. There are also, however, mechanical problems with existing centrifugal (and other rotary) pumps, such as infection through a shaft seal, possible seal leakage, thrombosis and blood injury in bearings.

The fact that such problems are still prevalent with rotary blood pumps, in spite of the large number of different developments that have taken place in recent years is attested to by reference to them in a number of papers presented at an International Workshop on Rotary Blood Pumps held in Baden, Austria Sep. 9–11, 1991. It was indicated that lack of a long-lived baring is the principal obstacle to the use of a continuous rotary pump as an implanted assist device. It was also found that bearing seals in rotary blood pumps were apt to fail when immersed in blood. If there were no seal for a rotating bearing in a rotary blood pump, such problems would not exist. It was also stated that blood leakage and thrombus formation about bearing or shaft seals still limit the clinical usage of centrifugal pumps, which require seals between the blood and bearings and actuators, and that commercially available disposable blood pumps can only be used on a patient for 48 hours before being replaced. The objective is for the development of a centrifugal blood pump which can provide over two weeks of continuous operation with an inexpensive replaceable pumping element.

In the past 10 years at least two blood pumps have been developed to achieve centrifugal pumping through creation of a vortex by a planetary impeller in order to eliminate rotating bearings in the bloodstream. In one such device, disclosed in German Patent 3133177, and known as a "Teaspoon" pump, a motor-driven bent shaft rotates within an elastomeric sheath, which causes a spherical circulator (or paddle) to nutate in an annular path within the pump housing. A conventional drive motor is located in an external area, which is sealed from the blood pumping chamber by the flexible sheath. Although this device provides a potential improvement over conventional centrifugal pumps by eliminating rotation bearings and seals in the blood chamber, with the attendant dangers of infection, air embolism, thrombosis and increased hemolysis, certain limitations can be noted. There is a frictional loss due to rubbing of the bent shaft as it rotates within the flexible nutating sheath. It is indicated the sheath material is some polyurethane compound, but it is not common for a material to have good bearing and flexing qualities simultaneously. Also, it is not possible to replace the pumping element separate from the motor and drive mechanism.

In another type of nutating pump named a "Precessional Centrifugal Pump", and disclosed in U.S. Pat. Nos. 4,722,660 and 5,044,882, a circulating element in the blood pumping chamber is mounted on the end of a straight shaft which is pivoted and eccentrically driven by an external motor to provide the nutation of the circulating element. The pivot is located at the center of a flexing sealing diaphragm. The circulating nutates in a closed annular track, which is said to provide superior performance. Here, too, the flexing seal introduces a potential weakness, and in this pump, also, the pumping element itself is not replaceable without the motor and drive mechanism.

U.S. Pat. Nos. 2,107,090; 2,773,453; and 3,702,938 are older patents for nutating devices with flexing external seals that are very similar in construction to the Teaspoon and Precessional Pumps described above.

There is an evident need for an extracorporeal blood pump with a relatively long-lived, replaceable and inexpensive pumping element that has no bearings or frictional contacts within the element that could damage the blood, and no external apertures that could be paths for leakage or contamination.

SUMMARY OF THE INVENTION

The invention disclosed herein is an ORBITING FLUID PUMP which provides improvements for pumping blood and other fluids where leakage to and contamination from the exterior, or where damage from or to the blood or other fluid by bearings in the fluid, can be detrimental.

Rotary blood pumps for circulatory assist and cardiopulmonary bypass contain bearings and external seals which limit the usage of replaceable pump heads due to thrombosis and blood leakage. The new orbiting fluid pump overcomes these limitations by eliminating any mechanical seal, either flexing or rubbing with the external environment and eliminating any frictional contact altogether.

A principal feature of all embodiments of the invention is that the pumping action is performed by a unitary, sealed, easily replaceable pumping element, which consists of a housing with a longitudinal axis, a pumping chamber at one end of the housing, an outlet in a wall of the pumping chamber, an inlet in the housing, axially spaced from the pumping chamber, a circulator in the pumping chamber, mounted on a support which is free of rotating elements and which provides freedom of motion for the circulator to revolve in an orbital path about the longitudinal axis, and magnetic means external to the housing to drive the circulator in its orbital path by magnetic action through the walls of the housing. The sealed housing is free of bearings, flexing seals or apertures leading to the exterior of the housing except for the inlet and the outlet. The orbiting circulator contains a magnetic element and it is driven in a circular path by an external rotating magnetic field to generated pressure and flow by a combination of centrifugal and displacement forces. The pump housing, which contains only the orbiting circulator and its support, is inexpensive and disposable.

In the preferred embodiment, the circulator support is a compliant shaft with an orbiting end connected to the circulator and a stationary end connected to the housing. The shaft and the circulator form a spring-mass system with a resonant frequency that is determined by the system stiffness and mass. In the preferred embodiment the circulator contains a magnet and it is driven by a rotating magnet, which is mounted on a DC motor external to the housing. Delivery is controlled by varying motor speed in a narrow band about the resonant speed which changes circulator eccentricity, so that a small change in speed can effect a large change in flow rate.

The outlet has a rectangular section and an axis that is tangential to the orbital path, and the inlet is co-axial with the longitudinal axis of the housing at the end opposite to the pumping chamber. A sensing circuit is provided external to the housing, with an output related to the field strength of the circulator magnet as a measure of the orbital excursion of the circulator.

In a variation of the pump outlet, a multiplicity of circumferentially spaced exit channels are introduced to connect the pumping chamber to an external channel, which is connected to the pump outlet, to improve performance by increasing the frequency and attenuating the intensities of cyclic flow and pressure variations, reducing turbulene, energy losses and blood trauma and balancing hydrodynamic forces on the circulator.

In a second embodiment on the invention a spherical circulator containing a permanent magnet is mounted on a rigid nutating shaft, and it is driven by a motor-related external permanent magnet in a circular orbit with a fixed excursion. A desirable feature of this arrangement is that the nutating shaft and the circulator are contained in a replaceable pumping element, which can be disposed of and replaced after each use. It is considered that with a fixed excursion for the circulator, and a guided, well-defined orbiting path, the higher pressures required for cardiopulmonary bypass will be achieved with a device of a relatively small size.

A variation of the magnetic driving means is applicable to both embodiments of the invention described above. Here the circulator includes a magnetic element, and the magnetic driving means includes a pair of electromagnetic coils, and each coil of the pair is energized by alternating current at a 90-degree phase relation to the other, to achieve a circular orbit of the circulator.

BRIEF DESCRIPTION OF THE DRAWINGS

The following detailed description of the preferred embodiments can be understood better if reference is made to the drawings, in which.

DETAILED DESCRIPTION OF THE INVENTION

Figure 1:
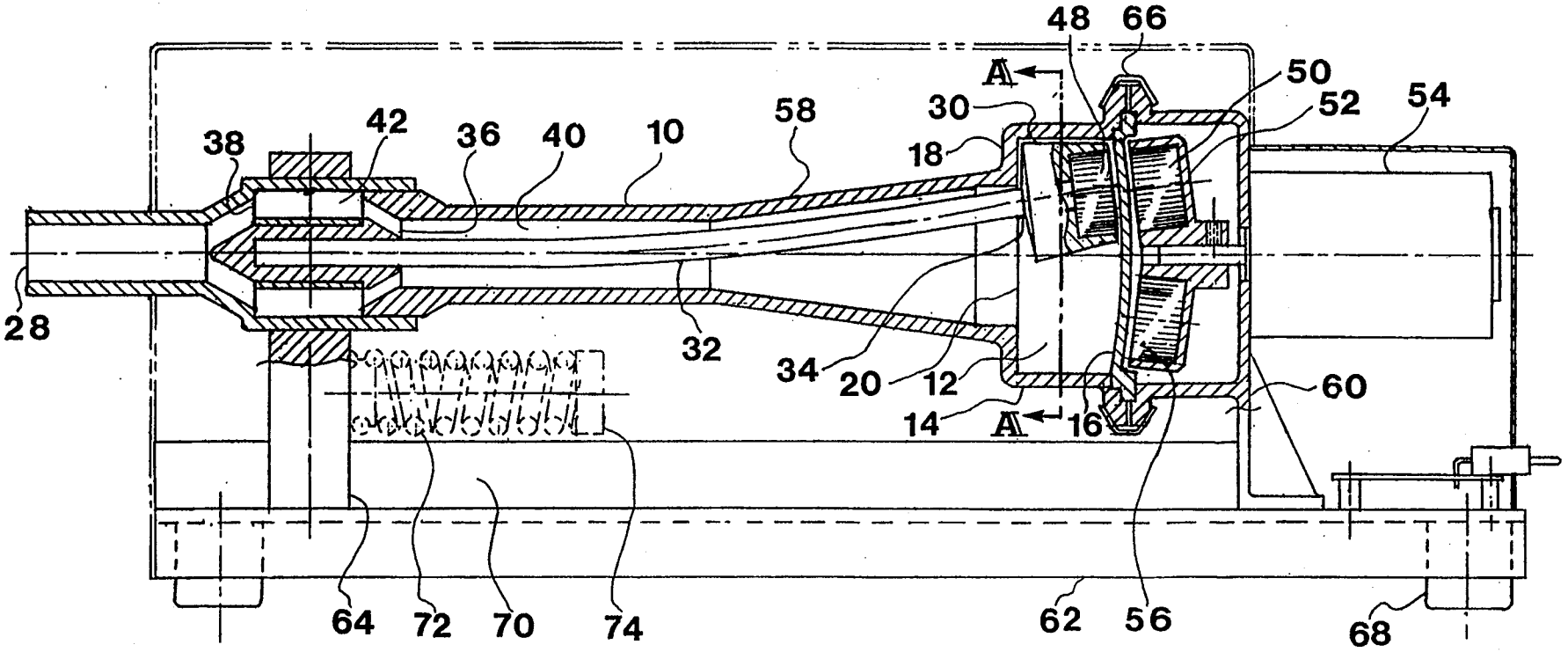
FIG. 1 is a sectional elevation view of the preferred embodiment of the invention illustrating the interactive relations among the major elements.
Figure 4:
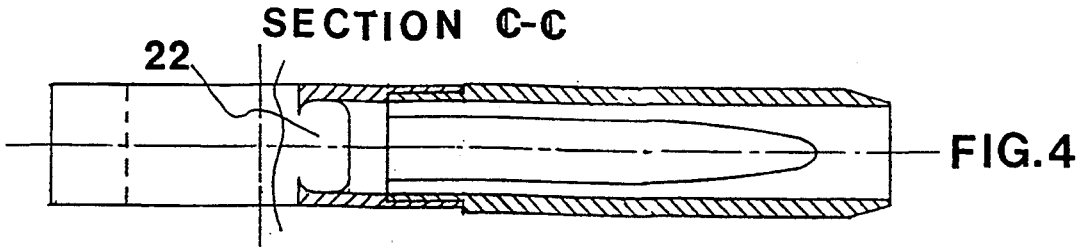
FIG. 4 is a sectional view along line and in direction C—C in FIG. 2, further clarifying the construction shown in FIG. 2.
Figure 2:
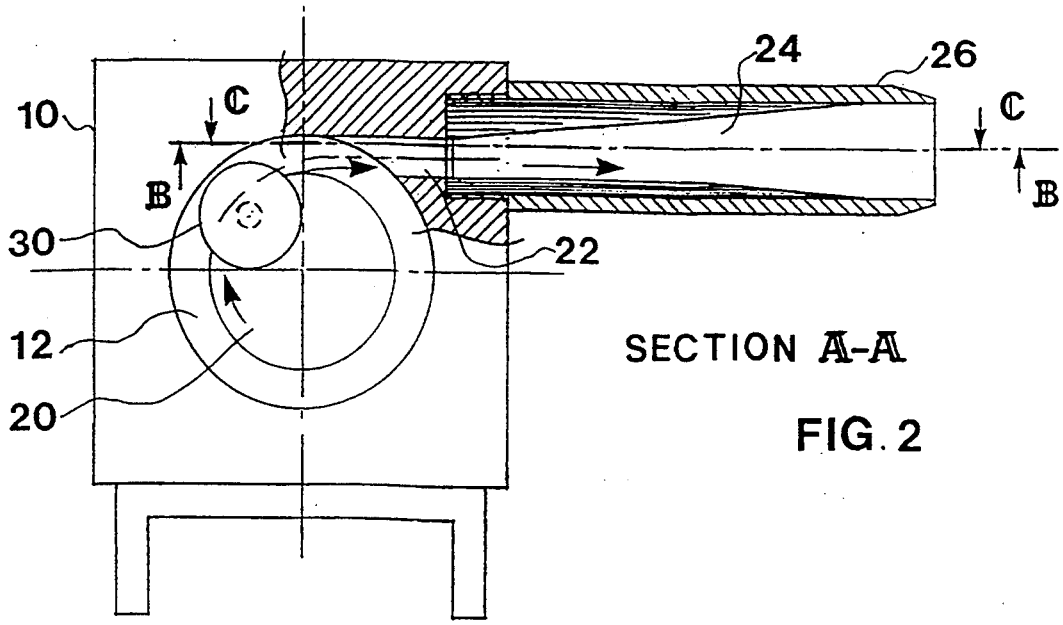
FIG. 2 is a sectional view along line A—A in FIG. 1, explaining details of the embodiment not shown in FIG. 2.
Figure 3:
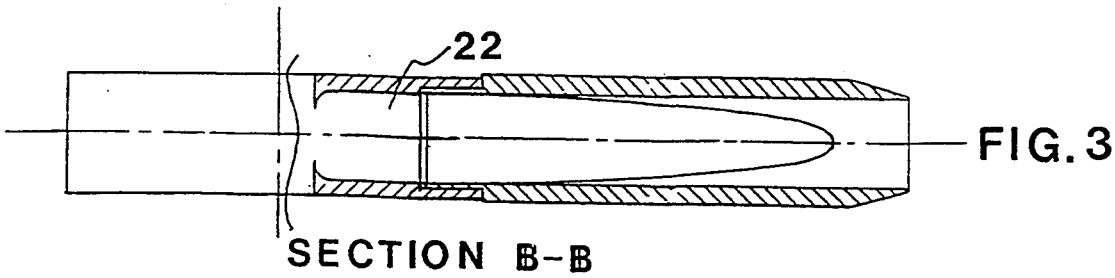
FIG. 3 is a sectional view along line and in direction B—B in FIG. 2, clarifying the construction shown in FIG. 2.

Referring to FIGS. 1–4, the preferred Orbiting Fluid Pump includes a housing 10 with a longitudinal axis and a pumping chamber 12 located at the front end of the housing. The pumping chamber is defined by a longitudinal co-axial wall 14, a continuous transverse wall 16, which closes the pumping chamber at the front end of the housing, and a second transverse wall 18 with a central opening 20, which is axially spaced from the continuous transverse wall 16. An outlet 22 is located in the longitudinal wall of the pumping chamber and it communicates through a diffuser 24 to the pump discharge 26. An inlet 28 is located outside of and axially spaced from the pumping chamber toward the opposite end of the housing. Between the front end and the opposite end, the housing is continuous and integral, and it is free of bearings with sliding or rotating shafts, flexing seals or apertures leading to the exterior of the housing, except for inlet 28 and outlet 22. A circulator 30 is located in the pumping chamber. The circulator is mounted on a support 32, which provides freedom of motion for the circulator to revolve in an orbital path within the pumping chamber. The circulator is driven in its orbital path within the pumping chamber by magnetic action through the walls of the housing from magnetic means located external to the housing. As shown in FIG. 1, circulator support 32 is a compliant shaft with a front, orbiting, end 34 connected to the circulator and an opposite, stationary, end 36 connected to the housing as a cantilever. The stationary end 36 of shaft 32 is built into a shaft support 38, which in turn is rigidly retained by housing 10. Shaft 32 and circulator 30 form a spring-mass system with a resonant frequency which is determined by the stiffness of the shaft and the masses of the shaft and circulator assembly. For best performance the circulator and shaft must be driven at or near the resonant frequency, so as to achieve the maximum orbital eccentricity of the circulator with minimum driving force. Since the pressure attained by the vortex generated by the orbiting circulator is determined by the orbital velocity, it is desirable to achieve the highest resonant frequency that is consistent with an optimal orbital eccentricity and shaft deflection.

Outlet 22 has an axis that is tangential to the orbital path of circulator 30 so as to achieve smooth flow into the diffuser. To minimize flow reversal as the circulator passes the outlet, the outlet is shown to have a rectangular section with the maximum ratio of width to height that is consistent with an adequate flow area in the outlet.

Figure 5:
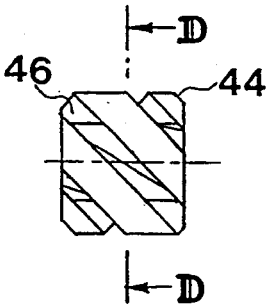
FIG. 5 is a view of a device in the inlet of the preferred embodiment, providing pre-rotation of flow.
Figure 6:
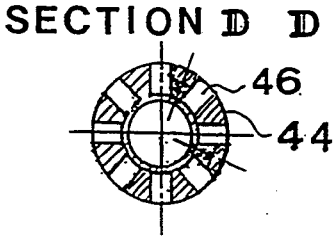
FIG. 6 is a sectional view along line D—D of FIG. 5, explaining the construction of the device.

Inlet 28 is at the opposite end of the housing 10 and co-axial with its longitudinal axis. To permit flow to pass from the inlet to the interior 40 of housing 10, shaft support 38 contains communicating flow passages. The shaft support 38 shown in FIG. 1 has axial flow passages 42 to minimize pressure drop. It has been found that performance is enhanced by pre-rotation near the inlet of the flow in the direction of circulator orbiting so as to establish a vortex in the housing interior 40 prior to flow through central opening 20 into pumping chamber 12. For the preferred pump embodiment shown in FIG. 1, this can be accomplished by providing an alternate flow-through shaft support 44 with spiral flow passages 46, as shown in FIG. 5 and FIG. 6.

In the preferred embodiment of FIG. 1, the magnetic action that drives the circulator 30 in an orbital path is a lateral magnetic attractive force that is exerted through the front transverse wall 16 on a magnetic element 48 in circulator 30 by an external drive magnet 50, which rotates in a plane parallel to the plane of the orbiting path of circulator 30 and whose axis of rotation is coincident with the longitudinal axis of housing 10. Magnet 50 is retained in a rotator 52 which is mounted on or connected to, and rotated by, the shaft of a drive motor 54, which is preferably, but not necessarily, of the DC type. The centrifugal inertial force of rotating drive magnet 50 is balanced by a counterweight 56 that is held in rotator 52 diametrically opposite to magnet 50. In FIG. 1 both magnetic element 48 and magnet 50 can be permanent magnets, preferably made of a high energy product rare earth material, such as neodymium-iron or samarium-cobalt. Alternatively, either magnetic element 48 or magnet 50, but not both, can be a temporary magnet, typically made of a high permeability iron. Finally, either could be an electromagnet. This would be more feasible for inclusion in the circulator, since the shaft does not rotate but bends, and flexible wires could be routed along the shaft for excitation of an orbiting electromagnet.

The drawings in FIGS. 1–4 show a complete field-usable Orbiting Fluid Pump. A principal feature of all the embodiments of the invention is that the pumping action is performed by a unitary, sealed, easily replaceable, pumping element, 58, which includes housing 10, circulator 30, shaft 32 and shaft support 38.

In FIG. 1 a separate inlet section is shown to be joined to a central housing section, but it is to be understood that this is a detail of assembly and that the sections are permanently joined to form the integral housing 10. Also, the stationary end 36 of shaft 32 is shown to be anchored in a separate shaft bushing, which is connected to the flow-through shaft support 38, but this is also a detail of construction, as the bushing could alternatively be an integral portion of shaft 32 or an integral portion of shaft support 38. On one end of the total pump assembly, the drive motor 54 with the magnet holding rotator 52 is mounted on a rigid motor support 60, which is fastened to a very rigid base plate 62. On the other end of the total pump assembly, the integral replaceable pumping element 58 is retained in a massive, rigid, support 64, which is also fastened to base plate 62. At its front end the replaceable pumping element 58 is attached to motor support 60 by a quickly-connectible V-band clamp 66. At the opposite end a swing-away clamp on support 64 (not shown) permits quick connection and disconnection of the pumping element from the support.

Although the rotating mass of magnet 50 is balanced by counterweight 56, there can be relatively large reactive forces transmitted through support 64, due to the relatively high deflection and stiffness of shaft 32, which can cause vibrations to be transmitted through base 62. Transmitted vibrations can be attenuated through use of relatively heavy supports and based mounted on springs or vibration-absorbing rubber vibration mounts 68. An optional means is use of one or more dynamic vibration absorbers, each of which is a spring-mass system, tuned to the same resonant frequency as that of the circulator and shaft system. Such absorbers are well known, and a dynamic vibration absorber 70, consisting of a spring 72 and a mass 74 is shown in dashed lines in FIG. 1 connected to support 64. The vibration absorber is excited by vibrations transmitted through support 64, but its reactions are in phase opposition to the exciting vibrations, tending to cancel them. Spring 72 could ideally be a shaft, similar to shaft 32, since spring 72 acts as a centilever and mass 74 moves in an orbital path. Use of a coil spring is shown because of design flexibility to minimize its length.

Prior pumps with orbiting impellers have fixed eccentricity and, therefore, a single degree of freedom for variation of output, namely, the rotational speed of the motor. The new orbiting fluid pump with a compliant circulator support, disclosed herein, has two degrees of freedom available, the rotational speed and the lateral excursion of the circulator, both of which are variable. These could be controlled independently by the speed and strength of the rotating magnetic field as, for example, if the circulator contained an electromagnet, by which field strength could be independently adjusted. In the embodiment shown in FIG. 1, however, the field is rotated by the permanent magnet in the motor-driven rotator, and the strength of the total field is determined by the non-adjustable strength of the individual fields of both permanent magnets. In the absence of an independent field adjustment (as with electromagnetic coils), there is only one parameter available to vary the output: the rotational speed.

Because the preferred embodiment should be operated at or near resonance of the compliant shaft and circulator, the excursion is a function of the speed. It is desirable to provide means to measure the lateral excursion of the circulator, both to modulate output and to avoid interference between the circulator and the longitudinal wall of the pumping chamber.

Tests of initial models of the preferred orbiting fluid pump embodiment were handicapped by lack of a reliable method to measure the circulator excursion. Attempts had been made to use a Hall effect magnetic field sensor to provide an output related to the position of the circulator magnet, but the signal was swamped by the varying field from the rotator magnet. A circuit was devised to eliminate the influence of the rotator magnet so as to provide an output related only to the excursion of the circulator magnet, hence, the circulator itself. This system has been assembled and teased, and it provides a very satisfactory measurement of the circulator excursion.

In essence, the magnetic circulator position sensing circuit uses two linear Hall effect sensors, spaced equidistantly from the rotator, with their signals effectively subtracted so that the influence of the rotator magnet produces a zero output from the circuit. One of the Hall effect sensors is located in housing 10 in proximity to the pumping chamber, and the other is placed at an equal distance, but on the distal side, of the rotator. The effect of the circulator magnet on the proximal Hall sensor is much greater than its effect on the distal Hall sensor, so that a very large output related to the circulator excursion is provided.

Figure 7:
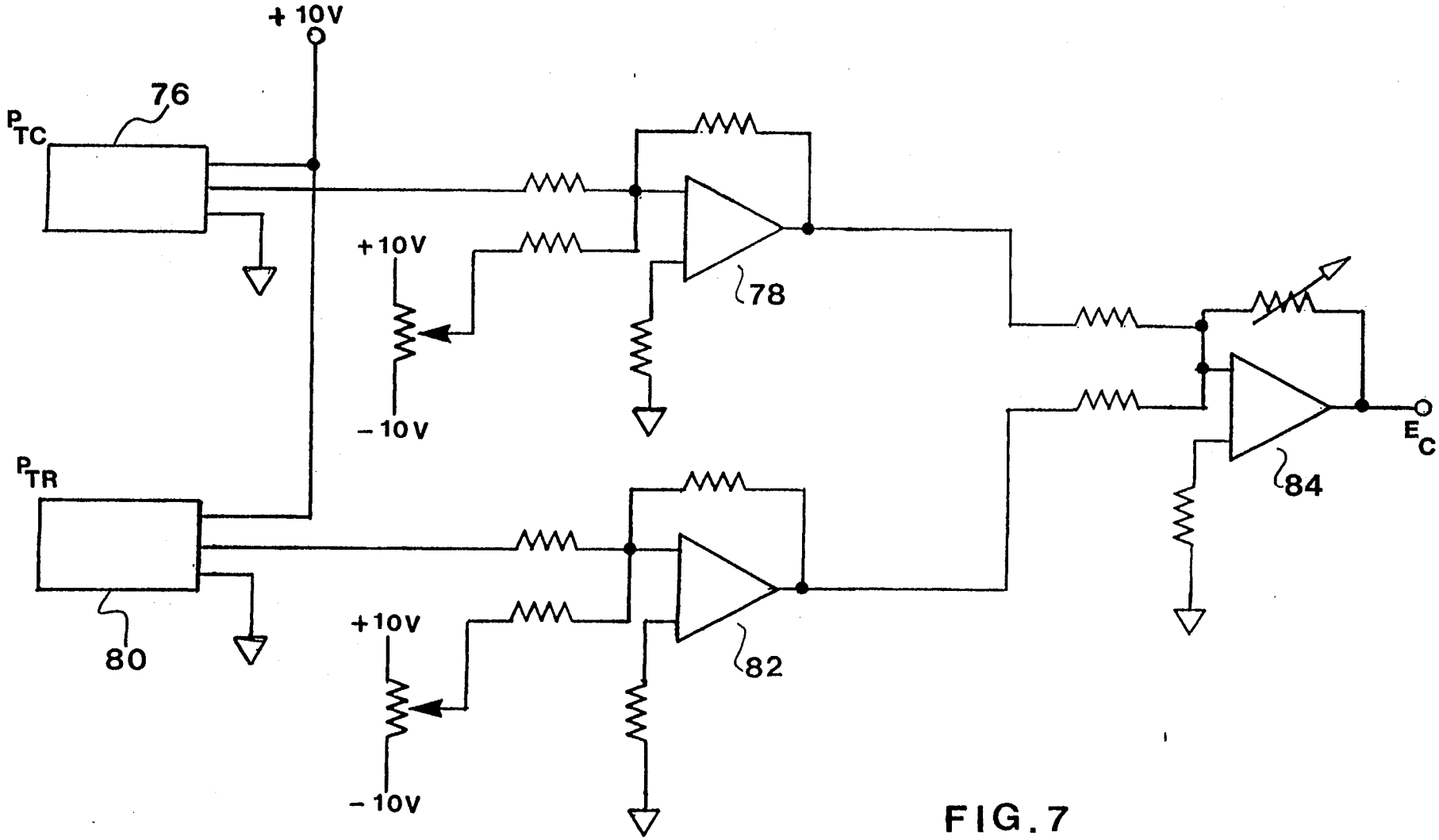
FIG. 7 is a schematic diagram of a system to measure the position of the flow impeller in the embodiment shown in FIG. 1.

The function of the differential magnetic circulator position sensing circuit will be evident by reference to the schematic diagram of FIG. 7. Hall effect circulator magnet position sensor 76, which is located in housing 10 near the pumping chamber 12, is energized by a supply voltage and provides an output related to the circulator magnet position to a circulator output amplifier 78. Hall effect rotator magnet position sensor 80, which is located on the motor support 60 near the rotator 82, is energized by the same supply voltage as Hall sensor 76, and provides an output related to the rotation magnet position to a rotator output amplifier 82. The outputs of amplifiers 78 and 82 are compared in a differential amplifier 84 whose output is an electrical signal related to circulator position. Table 1 provides an approximate calibration of the circulator position sensing circuit that has been used. Although the calibration is inexact, and although the calibration, as extended, is non-linear, the curvature is not severe, and a very large signal can be obtained with an output range from 0.125 in. to 0.500 in. excursion of approximately 4 to 1.

TABLE I

CALIBRATION OF CIRCULATOR POSITION SENSITIVE CIRCUIT OUTPUT

| Circulator Distance From Center Inches | Circulator Position Signal, $E_c$ mv |
|---|---|
| Center | <232 |
| 1/8 | 232 |
| 1/4 | 307 |
| 5/16 | 400 |
| 3/8 | 580 |
| 7/16 | 750 |
| 1/2 | 880 |

The Hall effect sensors, 76 and 80, can be of an inexpensive commercial type with linear outputs such as Micro Switch Type 91SS sensors. These sensors are of a sufficiently low price so that circulator sensor 76 can be disposed of when a pumping element is replaced. For greatest economy, circulator sensor 76 can be incorporated into a reusable element that is detached when a pumping element 58 is removed and reattached when a new pumping element is assembled.

Other means of measuring circulator or shaft position can be used. In an alternate method an electrode is placed in the internal surface of housing 10, at or just before entrance to the central opening 20 in transverse wall 18, the shaft 32 is made of metal or other conductive material, and an electrical circuit is completed between the shaft and the electrode. The electrical resistance between the electrode and the shaft is measured as a measure of the gap between the shaft and the housing wall at the electrode position. This method can only be used with a liquid that has sufficient electrical conductivity, such as impure water, blood or other aqueous solutions.

Recent test data for a model of the preferred orbiting fluid pump embodiment shown in FIG. 1, and incorporating a Hall position sensor, has revealed that the flow could be modulated over a narrow band of rotational speeds (i.e. 3,200 to 3,800 rpm; a change of approximately 1.2:1). This was accomplished by a change in motor terminal voltage of 1.44:1 (9 to 13 V) and accompanied by a change in output voltage of the magnetic circulator position sensing circuit shown in FIG. 7 of 2.67:1 (300 to 300 mv). Since the range of the position output values is on the order of twice those of the other parameters, and since a position sensor is required in any event to avoid possible interference of the circulator with the housing, it is practical to adjust and control circulator position (i.e. excursion) as the means of modulating pump output. It should be noted that a given voltage applied to the drive motor terminals results in a repeatable rotational speed and circulator position, so that control of motor drive voltage is a simple and reliable alternate means.

Figure 8:
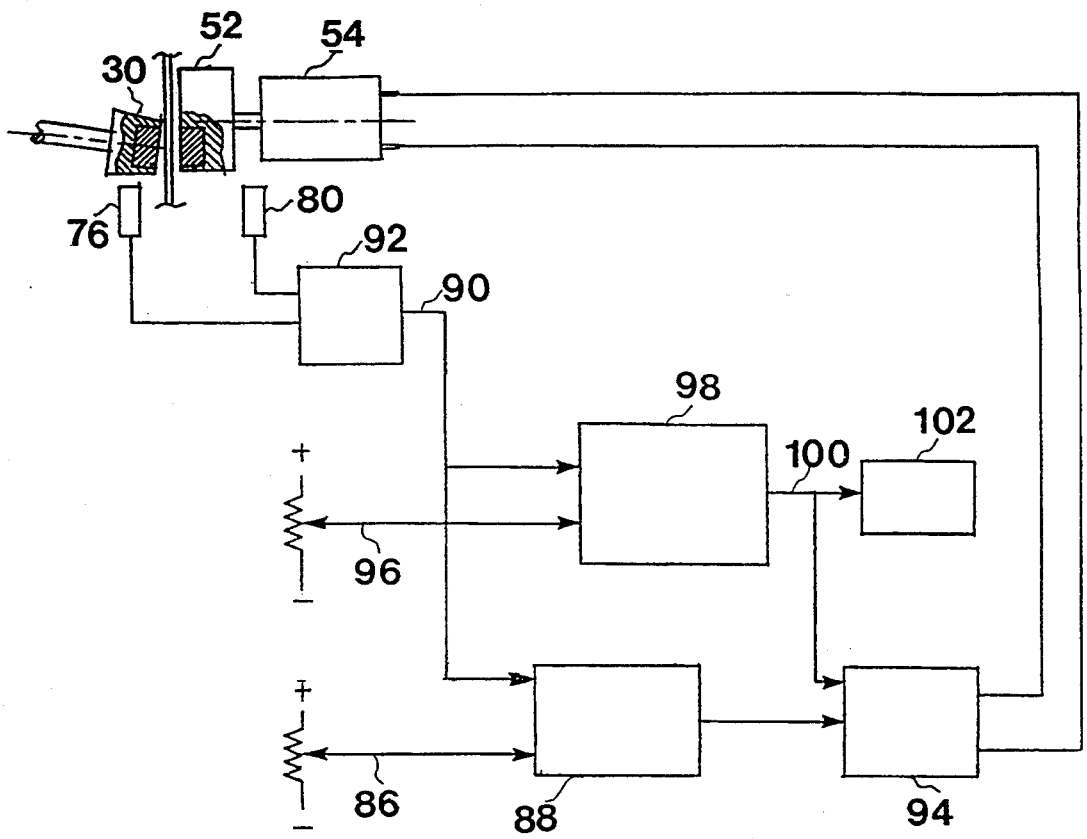
FIG. 8 is a schematic diagram of one type of system to control the output of the embodiment shown in FIG. 1.

FIG. 8 is a schematic diagram of a flow rate adjusting system in which the pump output is modulated by controlling the excursion amplitude of the circulator 30 at a selected value. The circulator position reference here is shown to be selected by a variable reference voltage 86, which is fed to a differential amplifier 88, where it is compared with the output 90 of the Hall effect circulator position sensing circuit 92 in a simple closed loop. The output of differential amplifier 88 is fed to the motor 54 through a power amplifier 94 to vary the motor speed so as to maintain the circulator position at the selected value. To prevent interference of the circulator with the housing wall, the maximum excursion of the circulator is limited to provide a minimum value of wall gap. A gap reference voltage 96 is pre-set and fed to a comparator 98 where it is compared to the gap voltage calculated from the output of the position sensor. If the gap is smaller than the pre-set value, an override signal 100 is fed to the power amplifier to reduce motor speed. If the condition persists, an alarm 102 is activated.

Figure 9:
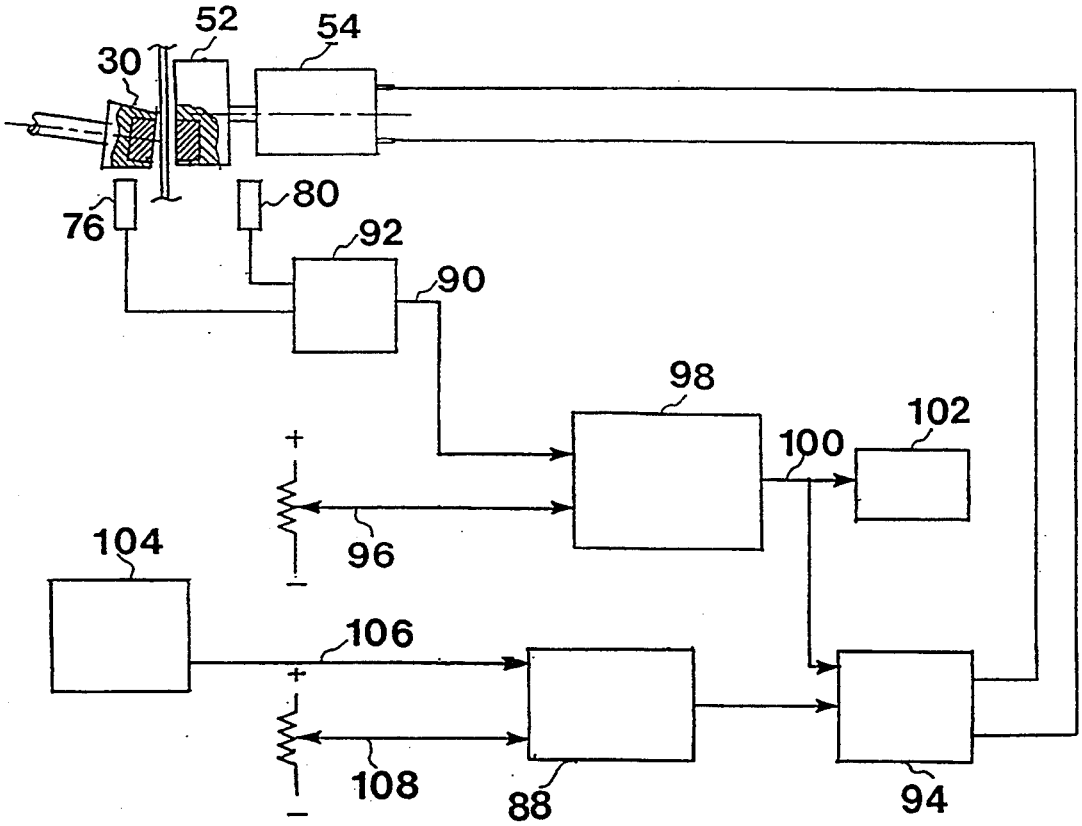
FIG. 9 is a schematic diagram of another system to control the output of the embodiment shown in FIG. 1.

A closed loop flow control system is shown in FIG. 9. Here, a flow rate sensor 104 provides a signal 106 related to the flow rate to the differential amplifier 88, where it is compared to a selected flow rate reference voltage 108. The remainder of the system is identical to that of FIG. 8. The flow rate sensor could be of the direct type, such as a commercial linear differential pressure flowmeter, an electromagnetic flowmeter, a Coriolis mass flowmeter, etc.

Inferential flow rate sensing could also be accomplished by calibrating the pump flow rate in terms of circulator excursion and pressure rise. The calibration curves are stored in a computer memory, and the measured excursion and pressure measurements are used to derive an inferred flow rate. It should be obvious from the foregoing discussion that other pump parameters, such as drive speed, or motor voltage could be substituted for circulator excursion in deriving a computer calculated inferred flow rate.

It has been stated above that a model of the preferred embodiment of the orbiting fluid pump shown in FIG. 1 was recently built and tested. The circulator is made as a conical frustum with a mean diameter of 1.9 in. and a mean length of 0.85 in. The pumping chamber is cylindrical with a diameter of 2.1 in. and a length of 0.92 in. The shaft has a diameter of 0.25 in. and an effective length of approximately 6.9 in., and it is made of high strength titanium alloy.

The mean natural frequency is approximately 375 cps. At the maximum circulator excursion (0.50 in.) the shaft end slope is at an angle of 7 degrees. The slop of the conical surface of the circulator is also made to be 7 degrees so that at the maximum deflection, the corresponding surfaces of the circulator and the chamber wall are parallel. The axial length of the pumping chamber is the minimum that will avoid interference with the circulator. The opening 20 in transverse wall 18 is made to have a minimum diameter, such that it would stop further excursion of the shaft before the circulator could make contact with the housing wall. Continuous transverse wall 16 is contoured so as to present a minimum axial clearance with the circulator 30 at any circulator excursion.

Performance tests of the orbiting fluid pump model described above were conducted to assess suitability as a blood pump, both for cardiac assist and cardiopulmonary bypass. Plots of the performance test data are presented in FIG. 10. Although the motor speed was measured both by a stroboscope as well as a laboratory counter, it was found to be more reliable to run a characteristic curve by setting a constant motor voltage than to attempt maintaining a constant speed. The variation of speed with pressure at constant voltage was very small, and the circulator excursion, as indicated by the output of the position sensing circuit, remained practically constant at constant voltage. The spread of speed over the voltage range was also quite small, varying from 3,200 to 3,650 rpm for a voltage change of 9 to 13 V. There was, evidently, considerable interaction between the rotator and the spring shaft-mounted circulator, which can be only driven over a narrow band near the resonant frequency, as the reactive forces at other frequencies are relatively large.

Figure 10:
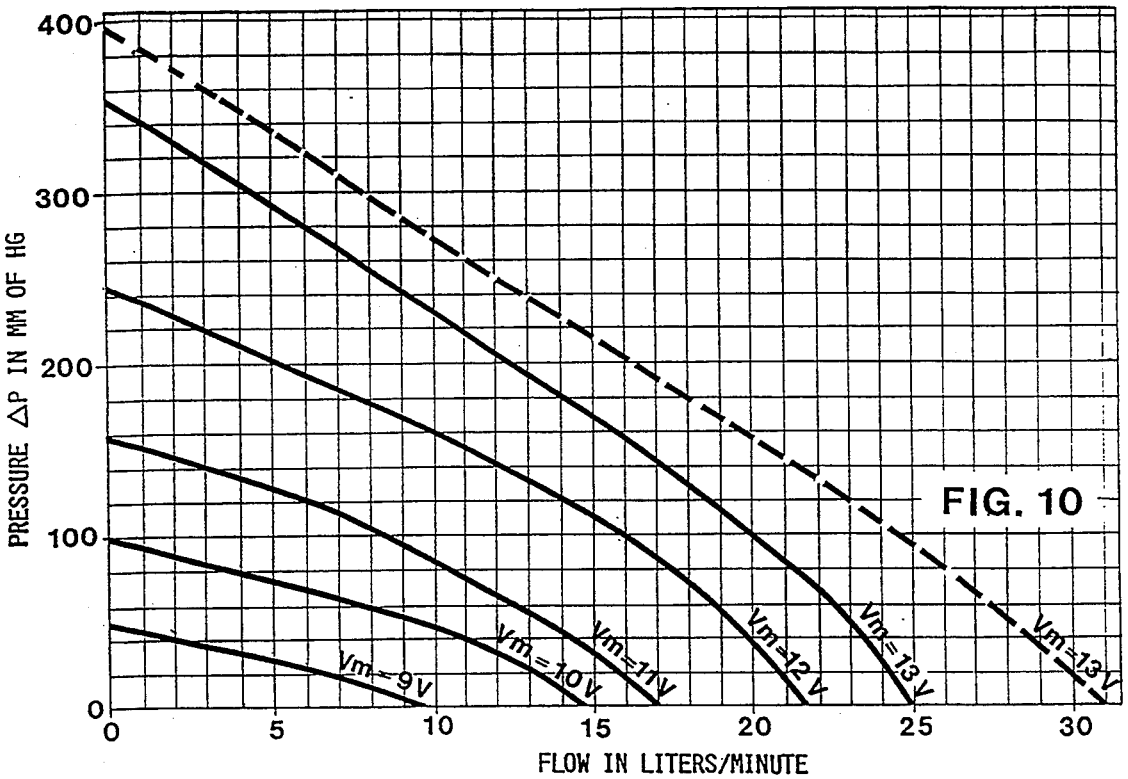
FIG. 10 is a set of characteristic performance curves for an orbiting pump model that incorporates features shown in FIGS. 1–4, plotted from recent test data.

Referring to FIG. 10, a complete set of characteristics at voltages of 9, 10, 11, 12 and 13 V was taken with the first unit assembly. These are plotted with bold lines. At 13 V and a flow rate of 8 lpm, the pressure rise is approximately 260 mm Hg, which is much greater than is required for an assist blood pump. At 5 lpm the pressure is 295 mm Hg, which is within the range of a bypass pump for use with oxygenators. The pump model was then partially disassembled and reassembled to reduce the axial clearance. With this assembly the performance improved, as shown by the bold, dashed line plot at 13 V, giving a pressure rise at 5 lpm of 340 mm Hg, and of 400 mm Hg at zero flow.

It is evident from the curves of FIG. 10 that performance is improved by maintaining small clearances between the interior walls of the pumping chamber 12 and the corresponding surfaces of the circulator. A uniformly small clearance between the interior of longitudinal wall 14 and the lateral surface of the circulator can be realized because of the cylindrical shape of the longitudinal wall and the conical shape of the circulator, providing parallelism between the surfaces at maximum excursion, where output is greatest. Parallel surfaces and small transverse clearances can also be realized with other circulator shapes. For example, the circulator could have a cylindrical shape, in which case longitudinal wall 14 would have a conical section, expanding to the front, from transverse wall 18 to transverse wall 16. In general, shapes with linear surfaces are preferred for the circulator, as the transverse and axial clearances with the walls of the pumping chamber can be independently controlled. A spherical shape for the circulator has some merit due to the smooth contour that could inhibit local eddy formation, which could be desirable to minimize blood trauma when pumping blood. But it is more difficult to maintain a uniform spherical clearance than independent axial and lateral clearances for other shapes.

It is not essential that the inlet be co-axial with the longitudinal axis of the housing as shown in FIG. 1, but the inlet could also be located in the wall of the housing 10 between transverse wall 18 of pumping chamber 12 and support 64, with an axis that is transverse to the longitudinal axis. Indeed in prior pumps with orbiting impellers, an inlet arrangement as that shown in FIG. 1 could not be used because the impeller is mounted on a rigid nutating shaft that is driven by an external motor connected to the opposite end of the shaft through a flexible seal, and in some pumps, a transverse inlet is used.

The effect of a transverse inlet and axial location of the inlet have been examined on an early model of the preferred orbiting fluid pump embodiment, which was made with multiple axially spaced, transverse inlets, including a distal inlet near the stationary end 36 of shaft 32, a proximal inlet, spaced axially from transverse wall 18 by a distance approximately equal to the width of opening 20, and an intermediate inlet, spaced axially from transverse wall 18 by a distance approximately equal to three times the width of opening 20. It was found that when both the proximal and distal inlets were open and the intermediate inlet was closed, flow began to discharge through the proximal inlet as the outlet was throttled and pressure increased above 24 mm Hg. With the intermediate and distal inlets open and the proximal inlet closed, some reverse flow was still noted at the intermediate inlet, but it began to appear at a higher pressure (60 mm Hg) than was the case for the proximal inlet. When a second distal inlet was added and both distal inlets were open, and the other inlets were closed, no flow reversal was noted in either inlet at any pressure. The effect noted can be attributed to a peripheral flow reversal at higher pressures effectively throttling flow at a transverse inlet as pressure is increased, if the inlet is too close to the pumping chamber.

Figure 11:
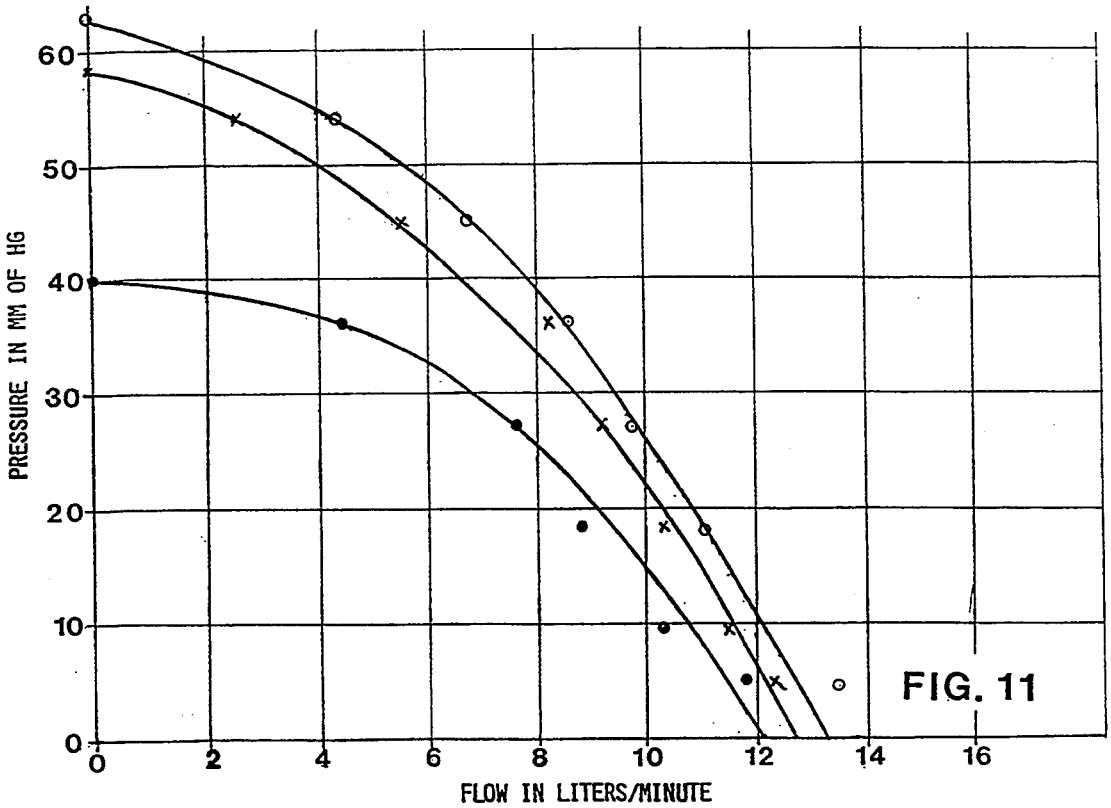
FIG. 11 is a set of characteristic performance curves for an orbiting pump model similar to that of FIG. 1, showing the effect of inlet location and orientation.

These observations are supported by the curve of FIG. 11 in which curve 110 represents performance with only the proximal inlet open, curve 113 represents performance with only the intermediate inlet open, and curve 114 represents performance with only the two distal inlets open. It can be seen from curve 110 that the output is lowest with the proximal inlet, and the curve 110 is flattest at low flow rates, confirming the pressure throttling discussed above. As was expected, the effect is less marked for the intermediate inlet, confirming the importance of axial separation for a transverse inlet. The value of the axial inlet in the preferred embodiment is demonstrated by comparison of the curves of FIG. 11 with the performance curves of FIG. 10 which exhibit little flattening at low flow rates, showing greater pressure recovery and efficiency.

Pumping by a single orbiting circulator through a single tangential outlet probably is accompanied by cyclic pressure and flow variations producing reversing flows through the opening into the pumping chamber. Although such effects are apparently reduced with a distal axial inlet, at high pressures there could be significant turbulence, and when pumping blood this could increase the risk of hemolysis and other blood trauma. In addition, unbalanced forces associated with such cyclic variations at high pressure could produce deviations of the orbit from a circular path. Performance should be improved in these respects by introduction of several peripherally spaced outlets which would increase the frequency and attenuate the intensities of cyclic flow and pressure variations, reducing turbulence, energy losses and blood trauma. In addition, hydrodynamic forces on the circulator5 would be balanced, preserving the circularity of the orbit.

Figure 12:
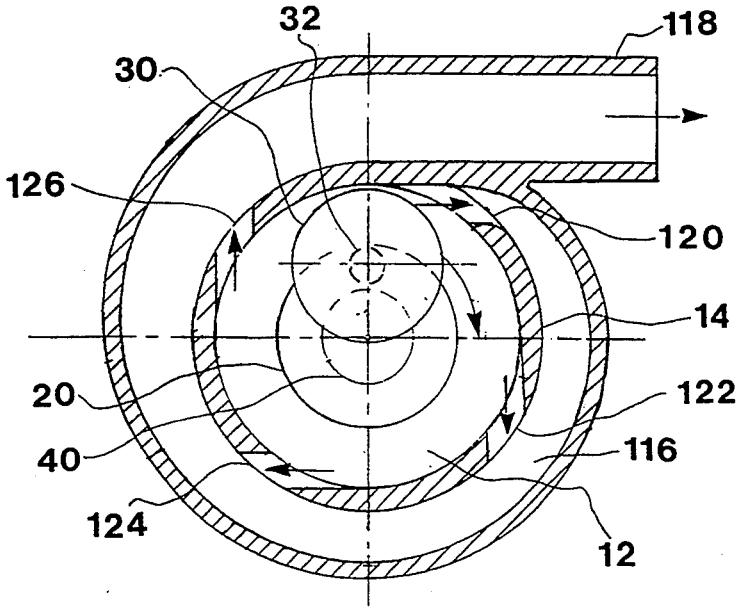
FIG. 12 is a sectional end view illustrating use of multiple outlets.

The use of multiple outlets can be understood by reference to FIG. 12, which is a section showing the pumping chamber, in which the longitudinal wall 14 of pumping chamber 12 is enclosed by an external channel 116 connected to the pump outlet 118. Longitudinal wall 14 contains a multiplicity of circumferentially spaced exit channels 120–123, connecting pumping chamber 12 to external channel 116. Exit channels 120, 122, 124 and 126 have axes that are tangential to the orbital path of the circulator and rectangular sections, similar to that of outlet 22 shown in FIGS. 2–4. As shown in FIG. 12, external channel 116 has the shape of a volute. Alternatively or additionally, a circumferential slot in longitudinal wall 14 could be used as an exit between pumping chamber 12 and external channel 116.

The preferred embodiment of the new orbiting fluid pump, which is shown in FIGS. 1–4 and described above and, and which has been experimentally studied, must be operated at resonant frequency, and the excursion of the circulator varies with the speed. For this reason, the circulator cannot be guided in a well-defined flow channel. As can be seen from FIG. 10, very good results have been obtained, with pressures and flow rates higher than those published for exiting nutating blood pumps, but to obtain the highest pressures, such as those that could be required for cardiopulmonary bypass (500–800 mm Hg) higher frequencies and excursions will be required, and if these levels are to be achieved, a substantially larger size may be required.

Figure 13:
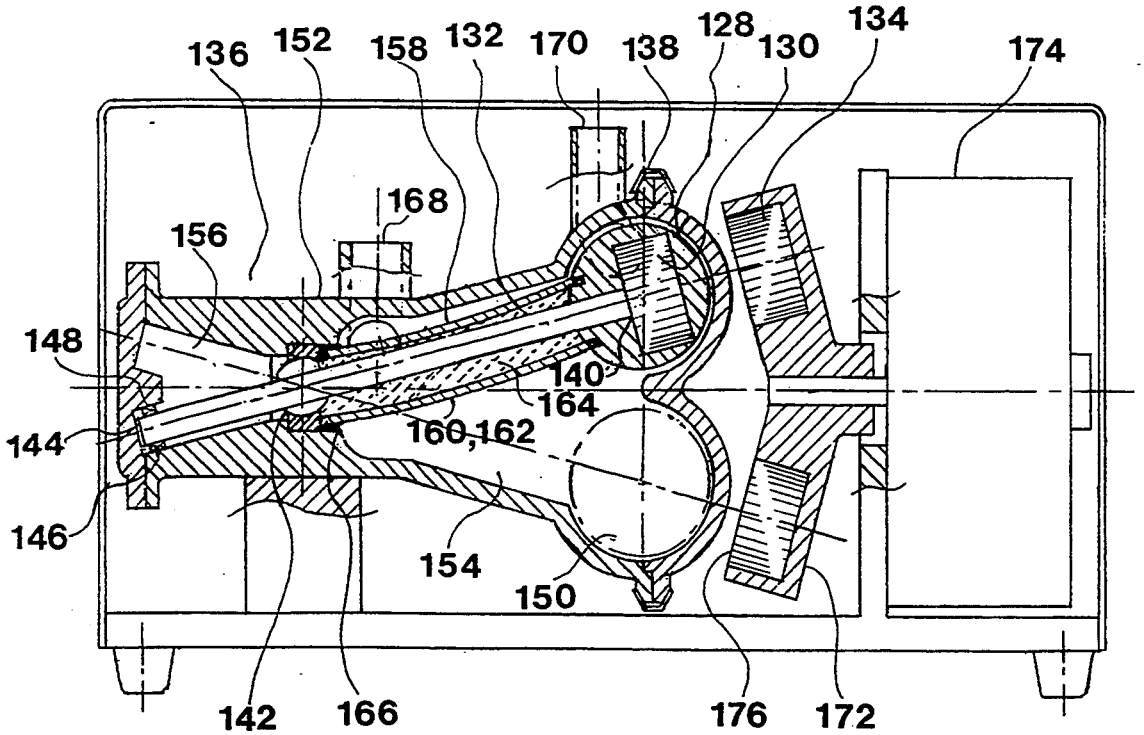
FIG. 13 is a sectional elevation view of a second embodiment of the invention.

It is considered that with a fixed excursion for the circulator, a guided, well defined orbiting path can be provided, and that this will permit the achievement of the higher pressures required for cardiopulmonary bypass with a device of a relatively small size. FIG. 13 shows such an embodiment of the invention, which still maintains the advantages of having a disposable pumping element with no bearings in the flow path and no external seals. This device is identified as a Guided Disposable Orbiting Pump (GDOP), as opposed to the Vibratory Orbiting Pump (VOP), in which the circulator is mounted on a flexing shaft, shown in FIGS. 1–4. In the arrangement drawing of a practical pump based on the disposable guided orbiting pump embodiment that is presented in FIG. 13, a spherical circulator 128 containing a permanent magnet 130, is mounted on a rigid nutating shaft 132, and it is driven by a motor-rotated external permanent magnet 134 in a circulator orbit. A desirable feature of this arrangement is that the nutating shaft 132 and the circulator 128 are contained in a replaceable pumping element 136, which can be disposed of and replaced after each use (e.g. 48 hours). The replaceable pumping element is easily inserted and removed. At the driver end, it is held to the permanent stationary drive housing by a V-band clamp 138. At the support end, the replaceable pumping element is held in place by a swing-away clamp. To remove the replaceable pumping element, a toggle lock on the V-band clamp is flipped to removed the V band. On the support end, a captive screw is unfastened, and a semi-circular clamping member is swung away. The replaceable pumping element is merely lifted out of the assembly and another one is put in its place; insertion requires the reverse clamping procedure. The entire removal procedure can be accomplished in one minute or less.

Referring again to FIG. 13, the spherical circulator 128 is attached to the front end 140 of the straight rigid drive shaft 132, that is supported at a point between the ends of the shaft by a pivot 148, which permits nutation of the shaft and the circulator. Shaft 132 extends through the pivot member and is guided at the end 144 opposite the circulator by a ball bearing follower 146 which travels in an angular track 148. The guided follower forces the shaft to nutate in a specific conical path and the circulator to orbit in a well defined annular pumping channel 150 with a circular section having an arc approaching 270 degrees. This should permit attainment of relatively high pressures. The pivot divides the housing 152 into two separate sections, a flow section 154, and a shaft guidance section 156. In the flow section 154 the rigid shaft 132 forms the core of a flexible composite member 158 consisting of a fluid (e.g. blood) compatible flexible sheath 160, made of polyurethane or an equivalent material, reinforced by a coil spring 162, the volume between the sheath, spring and shaft, being filled by a soft pliable elastomer 164, such as silicon rubber. The entire driving member 158 is pressed and bonded into the spherical circulator at the front end 140 and the flexible sheath and spring are pressed and bonded into the flow section wall 160 before the pivot member 152, so as to provide a flexible seal between the guidance section 156 and the flow section 154. It is to be appreciated that the sheath, spring and elastomer fill, flex only in bending; there is no rotation or sliding, and any shear stress is minor. No only does the coil spring reinforce the sheath, but it resists torque, preventing rotation of the drive shaft.

The guidance section 156 is filled with a harmless fluid, preferably a gas, such as carbon dioxide, but alternatively, sterile saline (when pumping blood) or a light silicon liquid. It should be appreciated that there are no bearings in contact with the pumped fluid (e.g. blood) and no external seals, rotating or static. The pumping element 136 is self-contained and completely sealed from the environment, except for the inlet port 168 and output port 170. The pumping section will have sufficient axial length that there will be no pressure throttling at the inlet port.

Because the rigid drive shaft 132 does not come in contact with the pumped fluid (e.g. blood), it can be made of any appropriate high strength material (e.g. titanium, stainless steel, etc.). A standard rod end fitting (e.g. Heim Uniball) is shown as an example of a pivot 142, but other members, such as special ball bearings (e.g. pure radial or a jewel pivot, could be used.

An example of a coil spring that could be used to reinforce the protective sheath for the geometry of FIG. 1 is a standard Lee No. LC-0676H-7 compression spring, having an outside diameter of 0.540 in., a wire diameter of 0.067 in., a free length of 1.50 in. and a spring rate in compression of 36.6 lb/in. The spring rate in bending of the coil spring has been found to be 3.1 lb/in. The maximum bending stress is approximately 100,000 psi, which for music wire is less than 40% of the yield stress, and safe in fatigue. The torsional spring rate is 7.0 in. lb/radian, and even for an improbable deflection as large as 1 radian, the shear stress is 76,000 psi, which is 27% of the yield stress and safe. As an example of a track follower (146), and ABEC 7 ball bearing with an OD of 0.3125 in. and a width of 0.125 in. is shown. If necessary, a larger size double row bearing (or needle bearing) could be used.

The driving magnet is contained in a rotator 172 which is mounted directly on the shaft of drive motor 174. As shown, both the driving and circulator magnets are made of neodymium-Tron, and each has a diameter of $\frac{3}{4}$ in. and a thickness of $\frac{3}{8}$ in. (Magnet Sales & Mfg. Co. #24DNE4824). The driving magnet 134 is balanced by a counterweight 176, diametrically opposite, in the driving rotator 172.

Figure 14:
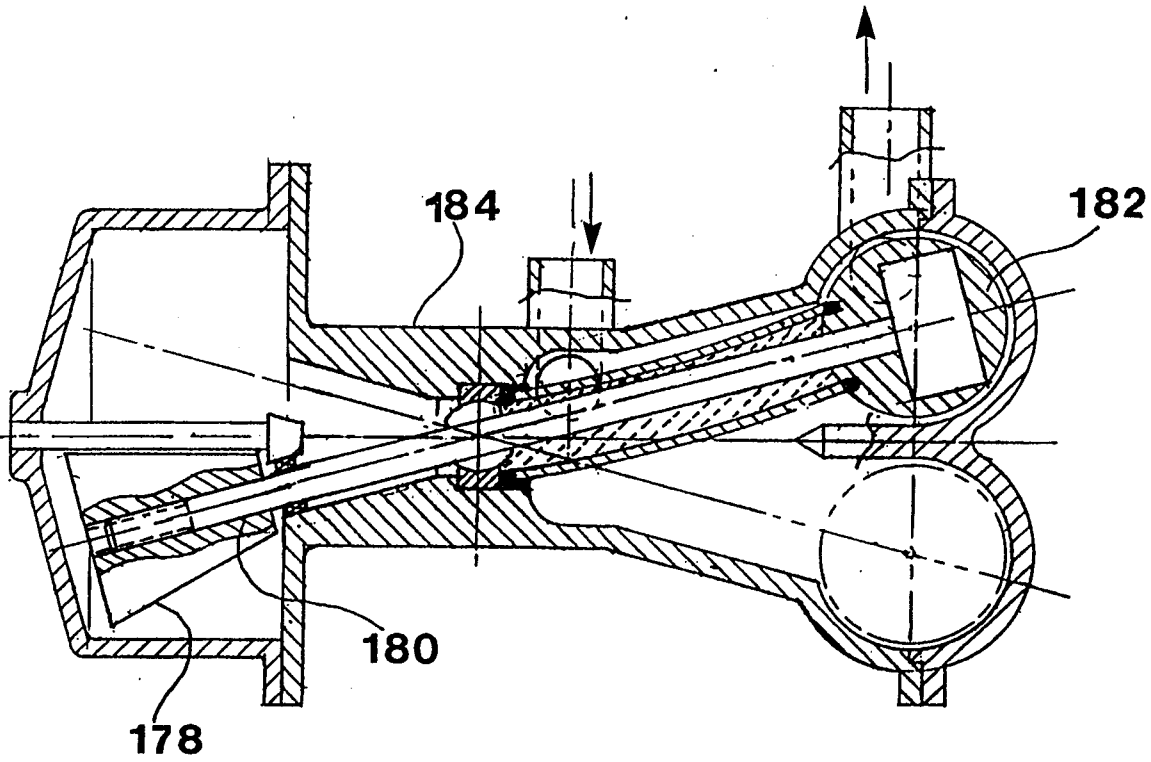
FIG. 14 is a sectional elevation view of a variation of the embodiment shown in FIG. 13.
Figure 15:
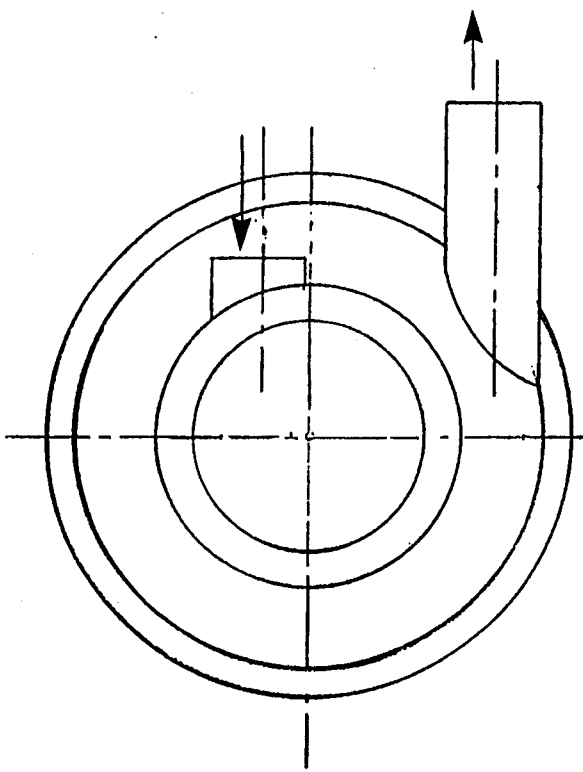
FIG. 15 is an end view of the embodiment shown in FIG. 44.

The design of the GDOP shown in the embodiment of FIG. 13 is capable of being directly balanced, by adding a counterweight to the end of the drive shaft opposite the circulator. FIG. 14 and FIG. 15 illustrate the use of a conical brass counterweight 178 on the end of drive shaft 180 that will balance the moment produced by acceleration of the spherical circulator 182 and eliminate vibration. This increases the length of the pumping element 184 by approximately one inch. The annular pumping channel 186 in FIG. 14 shows greater wrap-around of the circulator 182, aimed at reducing back-flow and increasing pressure rise.

The guided orbiting pumping element eliminates any bearings or external seals in the flow path. The drive might seem to have some similarity to the so-called "Teaspoon" pump disclosed in German Patent 3133177. But the "Teaspoon" pump has a circulator that is orbited by an eccentric shaft that rotates within a flexing polyurethane tube. Failure of the polyurethane tube, due to rubbing friction between the shaft and the tube, could case contamination from the exterior and fluid (blood) leaks to the exterior. In the pumping elements shown in FIGS. 13 and 14 the drive member is a composite. There is no rotation and no rubbing between the components. A rupture at the support connection is improbable, but in any event it would not be catastrophic, as communication could only be to a volume of sterile and non-toxic fluid. Also, the pumping elements are disposable, which is not possible with the construction of the "Teaspoon" pump.

Although the guided pumping elements shown in FIGS. 13 and 14 would be more expensive to make than that of the VOP, the additional cost is principally in the pivot, the tracking bearing and, possibly, the counterweight, which are not costly. The housing will be molded, so that an additional section adds little in cost. The design is compatible with a low-cost disposable pumping element.

Figure 16:
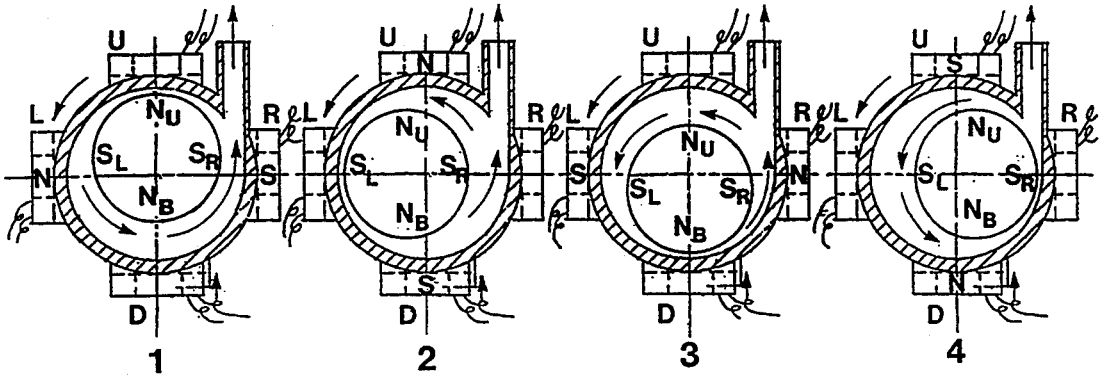
FIGS. 16, 17 and 18 illustrate the principle of operation of an alternate drive means, which is applicable to the embodiments shown in FIGS. 1–4 and FIGS. 13–15.
Figure 17:
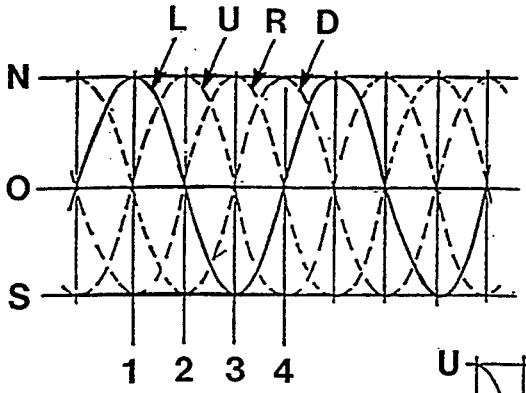
Figure 18:
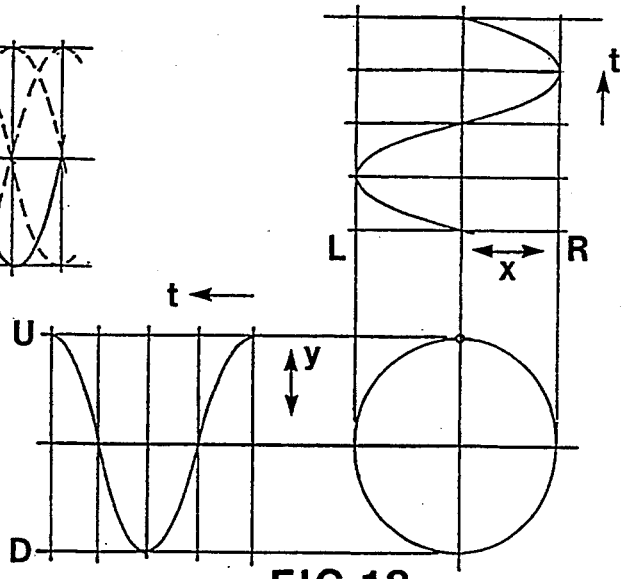

In another embodiment of the invention the orbiting circulator is mounted on a compliant support within an integral housing, forming a disposable pumping element, and it is driven in a cross two-phase vibration by magnetic action through the housing wall by external electromagnetic coils. Operation of the embodiment is illustrated in FIGS. 16, 17 and 18. For clarity in explanation, the circulator is shown to contain radial magnets, and radial stationary external coils are shown in an orthogonal spatial arrangement, but it is to be understood that the preferred arrangement uses axially oriented coils and magnet.

As shown in FIG. 16, the circulator has a circular cross section, and it contains four permanent magnets with their poles arranged so that there is an upper north pole ($N_U$), a bottom north pole ($N_B$), a left south pole ($S_L$) and a right south pole ($S_R$). The permanent magnets on the circulator are magnetically coupled with corresponding electromagnetic coils on the exterior of the pumping chamber having an "UP" coil (U) on top, a "DOWN" coil (D) on the bottom, a "LEFT" COIL (L) and a "RIGHT" (R). The coils are energized by alternating two-phase currents on the x and y axes in a 90 degree phase relation. The vortex is driven where the velocity is greatest, which is the condition of greatest power transfer along a particular axis. The velocity in either axial direction is greatest at the midpoint of travel and zero at the end points, so that the electromagnetic forces in either axial direction are greatest at the mid-point of travel. In position 1 of FIG. 16, the circulator is at the mid-point of travel in the vertical axis, where it changes direction. Coil L is energized as a north pole (N) to attract magnet $S_L$, and coil R is energized as a south pole (S), to repel magnet $S_R$. Coils U and D are at zero excitation. In position 2 of FIG. 16, the circulator is at the mid-point of travel in the vertical axis moving down, and at the left end of travel in the horizontal axis, where it changes direction. Coil D is energized as a south pole (S) to attract magnet $H_B$, and coil U is energized as a north pole (N) to repel magnet $H_U$. Coils L and R are at zero excitation. The excitation pattern is similar in positions 3 and 4 to drive the circulator so that it describes a circular orbit about the center.

A representative coil excitation diagram, corresponding to the position and forces for the diagrams of FIG. 16, is shown in FIG. 17. Alternating current patterns applied to Coils L, U, R and D, in positions 1, 2, 3 and 4, between amplitudes and polarities N and S, are illustrated. It is seen that the coils for each axis are energized in a 180 degree phase relation, so that they are operated in push-pull. The excitation of the coils in the two axes are in quadrature phase relation. The result of the 90 degree excitation and travel relation for the two axes is shown in FIG. 18. Because of the quadrature phasing, the center of the circulator describes a circular path. This is similar to the familiar Lissajour pattern on an oscilloscope when two sine waves of equal amplitude, but in 90 degree phase relation, are applied to the x and y deflection plates or coils.

Figure 19:
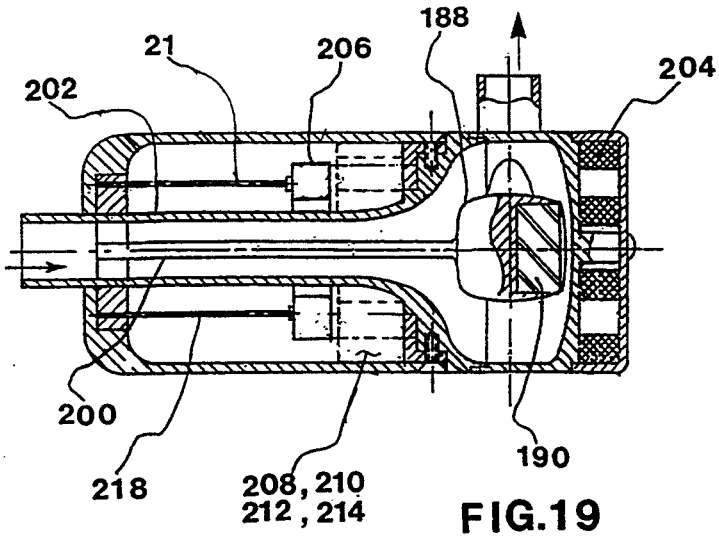
FIG. 19 is a sectional elevation view of another embodiment, similar to that of FIGS. 1–4, but using the drive means shown in FIGS. 14–16.
Figure 20:
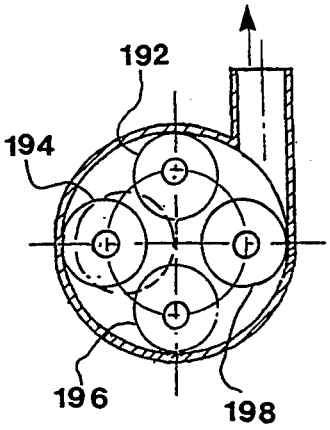
FIG. 20 is an end view of the embodiment shown in FIG. 17.

A sectional elevation view of a preferred arrangement for the embodiment with stationary electromagnetic coils is presented in FIG. 19 and an end view is shown in FIG. 20.

A polycarbonate circulator 188 contains an axially oriented neodynium-iron magnet 190 with a diameter of $\frac{3}{4}$ in. and a length of $\frac{3}{8}$ in., which is embedded into and completely encapsulated by the circulator. The circulator measures $\frac{7}{8}$ in. diameter by 1.0 in. length, and it has a curved barrel-shaped contour to eliminate sharp edges. The weight of 0.06 lb. (27 g).

The driving forces are those of lateral attraction and repulsion, and an advantage of this configuration is that the axial magnetic gap is constant. The circulator magnet is actuated by two pairs of axially oriented coils arranged in quadrature. The coils of each pair are connected in opposition, so that the current of a single phase is passed through the coils, and the magnet will be simultaneously attracted by one of the coils, and repelled by the other (push-pull). Each coils measures ¾ in. diameter by 1.2 in. long, and is wound with approximately 500 turns of #30 magnet wire. Four drive coils 192, 194, 196, 198 are used conforming to the basic operation described in FIGS. 16, 17 and 18. The drive shaft 200 is made of titanium. The housing 202 is made in two polycarbonate pieces, which are permanently joined by bonding after insertion of the circulator and shaft, to form an integral, sealed, disposable element. The reusable coil assembly 204 is fastened to the exterior of the housing with easily removable screws.

To minimize transmission of vibration, a balancing arrangement, which, like the tines of a tuning fork, will cancel vibrations in the support, is illustrated in FIG. 19. The simplest device is a dynamic (Frahm) vibration absorber, which is tuned to resonate at the same frequency as the circulator and its suspension. An alternate balancing scheme, utilizing a ring magnet 206 as part of the vibration balancing mass, is driven by four axial balancing coils 208, 210, 212, 214 in fashion similar to a fluid circulator but in opposite directions, so that the forces applied to the inlet support by the balancing rods 216, 218 are equal and opposite to those applied by the central circulator support shaft. Tests of the two devices have shown that the driven balancer is only slightly more effective than the dynamic vibration absorber, which is the device of choice.

The system is driven at resonance, because the reactive forces required to provide the excursion are large compared to the resistive load. Since the system should be isotropic, it should be sufficient to drive one axis in self resonance with a conventional positive feedback circuit. The physical parameters establishing stiffness and mass of the vibrating system should be substantially constant, particularly at the temperature range of operation, and it is possible to drive the system at a fixed frequency. A vibration velocity or displacement signal is required, at least in limit, to avoid interference with the housing.

The embodiment using driving coils is capable of constant frequency operation at the center resonant frequency, since flow can be varied by adjustment of vibration amplitude through modulation of the coil currents, which modulates field strength, although speed can also be adjusted as in the previous embodiments. Modulation of field rather than speed lends itself to pulsatile operation.

Figure 21:
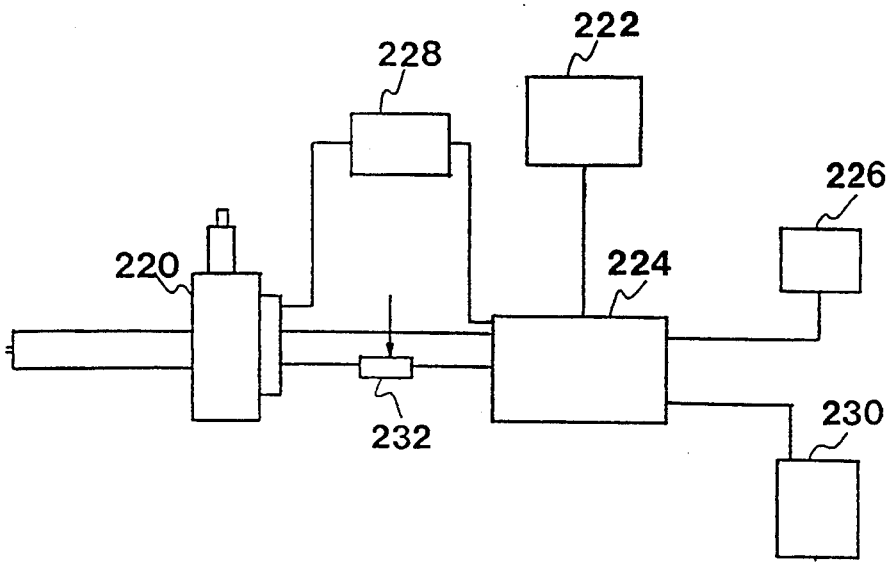
FIG. 21 is a block diagram of a system designed for pulsatile operation of the embodiment of FIGS. 17 and 18.

A block diagram of the basic system is shown in FIG. 21. The vibratory orbiting pump 220 is driven from a power supply 222 and a driver amplifier 224. The vibration frequency is controlled at resonance by adjustment of a carrier frequency generator 226, and two-phase operation is achieved by passing the carrier through a phase shifter 228. For pulsatile operation, the carrier is modulated from a modulation generator 230. Drive current sensor 232 provides a signal to indicate resonance.

Figure 22:
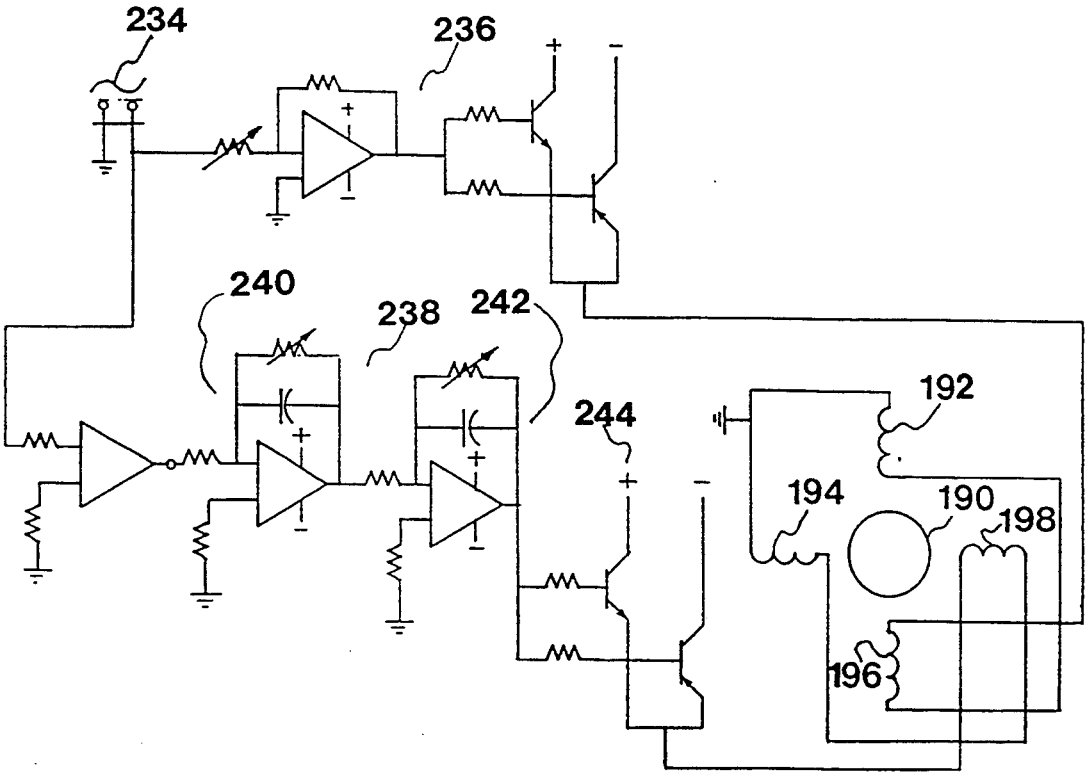
FIGS. 22 is a schematic diagram of a system for driving the embodiment shown in FIGS. 17 and 18 in accordance with the operation explained in FIGS. 16–18.

FIG. 22 is a schematic diagram of a system to drive the stationary electromagnetic coils of the embodiment illustrated in FIGS. 29 and 20, in accordance with the operation described in FIGS. 16–18, and included in the block diagram of FIG. 21. An alternating signal 234 from the carrier generator 226 is fed to an in-phase drive amplifier 236 as well as to a quadrature phase drive branch 238, which consists of two 90-degree phase shifters 240 and 242 and an amplifier 244. As described for the embodiment of FIGS. 19 and 20, each set of coils is connected so that current passes through each coil of the set in opposite sense to provide push-pull operation.

What is claimed is:

1. An orbiting fluid pump, comprising:

(a) a housing with a longitudinal axis, said housing having a first end and a second end spaced apart on the axis.

(b) a pumping chamber at the first end of said housing, said pumping chamber being defined by a longitudinal co-axial wall, a first, continuous, transverse wall to close said pumping chamber at said first end of the housing, and a second transverse wall with a central opening, axially-spaced from said first transverse wall.

(c) an outlet in the longitudinal wall of said pumping chamber, (d) an inlet in said housing, outside of, and axially spaced, from said pumping chamber, said housing being free of bearings, flexing seals or apertures leading to the exterior of the housing except for said inlet and outlet, (e) a circulator in said pumping chamber, said circulator being mounted on a support, which is free of rotating elements, and which provides freedom of motion for said circulator to revolve in an orbital path about the longitudinal axis of said housing, and magnetic means external to the housing to drive the circulator in an orbital path within the pumping chamber by magnetic action through the walls of the housing.

2. An orbiting fluid pump as claimed in claim 1, in which said circulator support is a compliant member.

3. An orbiting fluid pump as claimed in claim 2, in which said compliant support is a shaft with a first, orbiting, end connected to the circulator and a second, stationary, end connected to the housing.

4. An orbiting fluid pump as claimed in claim 2, in which said magnetic driving means drives said circulator in its orbital path at a speed which is near the resonant frequency of the circulator and its compliant support.

5. An orbiting fluid pump as claimed in claim 1, in which said outlet has an axis that is tangential to the orbital path of said circulator.

6. An orbiting fluid pump as claimed in claim 5, in which said outlet has a rectangular section.

7. An orbiting fluid pump as claimed in claim 1, in which said inlet is located at the second end of said housing and is coaxial with said longitudinal axis.

8. An orbiting fluid pump as claimed in claim 1, in which said inlet has an axis that is transverse to the longitudinal axis and is spaced axially from said second transverse wall of said pumping chamber by a distance that is no less than three times the width of the opening in said second transverse wall.

9. An orbiting fluid pump as claimed in claim 1, in which said circulator includes a magnetic element, and said magnetic driving means includes a rotating magnet.

10. An orbiting fluid pump as claimed in claim 1, in which said circulator includes a magnetic element, and said magnetic driving means includes a pair of electromagnetic coils, and each coil of the pair is energized by alternating current at a 90 degree phase relation to the other.

11. An orbiting fluid pump as claimed in claim 1, in which said inlet includes means to apply pre-rotation in the direction of the circulator orbit.

12. An orbiting fluid pump as claimed in claim 1, including means to control the orbital speed of said circulator.

13. An orbiting fluid pump as claimed in claim 1, including means to control the circulator excursion.

14. An orbiting fluid pump as claimed in claim 1, in which said longitudinal wall of said pumping chamber is enclosed by an external channel connected to an outlet, and said longitudinal wall contains a multiplicity of circumferentially spaced exit channels, connecting said pumping chamber to said external channel.

15. An orbiting fluid pump as claimed in claim 1, in which said circulator includes a permanent magnet, and including a stationary sensor external to the housing to sense the field from the permanent magnet, and to provide an output related to the excursion of the circulator.

16. An orbiting fluid pump as claimed in claim 1, in which said circulator support is a straight rigid shaft connected to the circulator at its front end and guided at the end opposite to the circulator to travel in an angular track, said rigid shaft being supported by a pivot between the ends of the shaft to permit nutation of said shaft and said circulator.

17. An orbiting fluid pump as claimed in claim 16, in which said housing is divided at the pivot into a flow section containing said pumping chamber, said inlet and said outlet; and a shaft guidance section containing said angular track; and including flexible sealing means between the two sections.

* * * * *